United States Patent [19]

Kobayashi et al.

[11] Patent Number: 4,723,676

[45] Date of Patent: Feb. 9, 1988

[54] SEALED CONTAINER AND CONTAINER CLOSURE

[75] Inventors: Nobunori Kobayashi; Kenji Imada, both of Saitama, Japan

[73] Assignee: Hokkai Can Co., Ltd., Tokyo, Japan

[21] Appl. No.: 872,848

[22] Filed: Jun. 11, 1986

[30] Foreign Application Priority Data

Jun. 14, 1985 [JP] Japan ..... 60-128090

[51] Int. Cl.[4] ..... B65D 41/02

[52] U.S. Cl. ..... 215/301; 215/317; 220/282

[58] Field of Search ..... 215/301, 316, 317, 321; 220/282

[56] References Cited

U.S. PATENT DOCUMENTS

| | | | |
|---|---|---|---|
| 1,609,470 | 12/1926 | Hammer | 215/317 |
| 2,008,798 | 7/1935 | Rossiter | 220/282 |
| 3,741,431 | 6/1973 | Burdick | 220/282 |

FOREIGN PATENT DOCUMENTS

| | | |
|---|---|---|
| 106614 | 4/1984 | European Pat. Off. . |
| 5711749 | 1/1982 | Japan . |
| 5711750 | 1/1982 | Japan . |
| 429566 | 5/1935 | United Kingdom . |
| 432067 | 7/1935 | United Kingdom . |
| 453035 | 9/1936 | United Kingdom . |

*Primary Examiner*—Donald F. Norton

*Attorney, Agent, or Firm*—Sandler & Greenblum

[57] ABSTRACT

A sealed container is provided comprising a container body and a container closure. The container body comprises a main barrel-shaped body portion, a closed lower end and an open upper end, together with a generally peripherally extending ridge and an outwardly extending ear. The container closure comprises a generally circular top panel, a downwardly depending peripheral wall terminating in a curled lower end edge, and a generally outwardly extending mounting projection which is adapted to engage a mounting projection extending inwardly from the peripheral wall of the closure. The closure can be easily removed from, and positioned onto, the container body; and the opening and closing operations can be performed safely.

14 Claims, 5 Drawing Figures

PRIOR ART

SEALED CONTAINER AND CONTAINER CLOSURE

BACKGROUND OF THE DISCLOSURE

1. Field of the Invention

The present invention generally relates to a sealed container which comprises a container and a container closure which is arranged to be repeatedly opened and closed on the body of the container.

2. Discussion of Relevant Information and Prior Art

It is known that sealed containers for foods, e.g., powdered milk or wax, require closures which can be repeatedly opened or closed. With such apparatus it is necessary, each time the container is used, that it be both opened and closed. Accordingly, conventional sealed containers have been developed in which the container body and the closure for the container are threadably and detachably engaged to each other.

Such sealed containers are inconvenient, however, particularly when the sealed container is relatively large in diameter, e.g., in the case of a powdered milk can or similar structure, because it is difficult for a user to use his fingers to grasp such a large container closure. Under such circumstances, a relatively large force is required to open and close the container; particularly when the hand of a user is small, it is difficult for the user to open and close the container.

Other types of container opening and closing arrangements have been proposed which are alternatives to the threaded type of closing arrangement discussed above. In one example of such prior art, as illustrated in FIGS. 4A and 4B of the present case, and as disclosed in Japanese Unexamined Utility Model Application Publication Nos. Sho/57-11749 and Sho/57-11750, a thin metallic plate material is formed into a container closure (c), the container closure having a downwardly depending peripheral wall portion (a) provided with an arcuate cut-out opening (b) which surrounds or defines an arcuate cut-out lower edge, extending in the form of an arc from a lower edge of peripheral wall portion (a) towards an upper surface of the wall portion. The closure is mounted at peripheral wall portion (a) to an outer surface of peripheral wall (f) of container body (e), which container body includes an outer peripheral ridge (d).

The type of sealed container described above is opened in a fashion such that, if a portion of top panel (g) of the container closure (c) which is located above cut-out opening (b) is pushed downwardly, as illustrated in both FIGS. 4A and 4B, the two lower edge or end portions (h), located along both sides of the arcuate cut-opening (b), will be in contact with ridge (d) of container body (e), and thus the two ridge points which contact end portions (h) will serve as fulcrums for the pivoting opening movement of the closure. By so functioning, an area of peripheral wall portion (a) of container closure (c), which includes the cut-out opening portion (b), will be moved downwardly at an angle, whereas a region of peripheral wall portion (a) of container closure (c) which is located on the side of the closure opposite to cut-out opening portion (b) will be moved upwardly and removed from container body (e). This motion is best illustrated in FIG. 4A, in which only the recessed portion remains on the container body.

These types of arrangements, however, are particularly useful for making large diameter sealed containers, e.g., powdered milk cans or similar structures, in which top panel portion (g) of container closure (c) is formed with a sufficiently large area making it necessary to provide a cut-out opening portion (b) along peripheral wall portion (a) of container closure (c) with a sufficiently large width or span between lower edge portions (h). In this structure, there is a problem when top panel portion (g) of container closure (c) is pushed downwardly along a region located directly above cut-out opening portion (b) in order to open the closure, insofar as the depressed region of top panel portion (g) will be bent or deformed downwardly; and as a result of this downward deformation, cut-out opening portion (b) of peripheral wall portion (a) will be undesirably widened in a substantially side-to-side fashion over the span between lower edges portions (h,h), which will prevent the opposed side portions of container closure (c) from being easily lifted and render it difficult to open the container closure. Further, if the cut-out opening portion (b) is too large, the pushing or depressing force acting on the area of the top panel portion (g) will cause lower edge portions (h,h) to move outwardly, so that these opposite edge portions located along both sides of cut-out opening portion (b) will be removed from ridge (d) of container body (e); in this fashion, the two spaced ridge points which are in contact with lower edge portions (h,h) will be prevented from serving as fulcrums and it will be impossible to open container closure (c).

Additionally, it is desirable to curl the entire circumference of the lower edge of peripheral wall portion (a) of the thin metallic plate material which comprises container closure (c) in order to prevent danger to users resulting from injuring their hands or fingers on the lower edge of the metal plate material. It is, however, extremely difficult to curl the arcuate lower edge of the closure which surrounds cut-out opening (b) in the prior art closures, so that an additional danger which is difficult to eliminate will remain.

OBJECTS OF THE INVENTION

Accordingly, a general object of the present invention is to provide a new and improved sealed container and a closure for the container which overcome the above-noted problems.

Another object of the present invention is to provide a new and improved sealed container and a closure for the container which overcome the problems which exist with conventional container closures, and which can be easily opened only by pushing a top panel portion of a container closure.

Another object of the present invention is to provide a new and improved sealed container and a closure for the container which provide for a container closure which can be easily removed from the container body in a safe and reliable fashion, even when the container has a large diameter.

SUMMARY OF THE INVENTION

The above and other objects, features and advantages of the present invention can be provided for in a first aspect thereof by a sealed container having an inner surface in the form of a tubular peripheral wall portion which extends downwardly from the entire circumferential edge of a top panel of a container closure which is mounted in an air-tight fashion about the outer surface of a peripheral wall and onto the open end of a container body. The outer surface of the container body peripheral wall has, along a peripheral portion of the container body, a mounting projection which adapted to be pressed into abutment with a similarly-configured mounting projection on the inner surface of the peripheral wall portion of the container closure. The container body is further provided, at an area below the mounting projection and along the periphery of the container body, with a ridge which is to be brought into engagement with a lower edge of the peripheral wall of the container closure when the closure is positioned over an open end of the body. In this fashion, a space will be formed between the lower closure wall edge and first and second opposite ends of a main ridge portion, so that when an area of the top panel of the container closure which is located above the space defined between opposite ends of the ridge is pushed downwardly, spaced first and second portions of the lower edge of the peripheral wall of the container closure will remain in engagement with opposite ends of the ridge and will function as fulcrums for pivotal movement of the closure. Simultaneously, that portion of the peripheral wall of the container closure which is located above the space and between the spaced lower edge portions will be permitted to move downwardly at an angle into the space, while the region of the peripheral wall of the container closure which is located oppositely from the space will be moved along an angle upwardly to disengage the closure from the container body.

The present invention is provided for in another aspect thereof by a selectively sealable container comprising a container body and a container closure. The containe closure has a top panel and a depending peripheral wall extending downwardly from the circumference of said top panel; the container closure is adapted to be mounted in a substantially air-tight fashion over an exterior surface of an open upper end of said container body. The container body comprises the open end and has a mounting projection located circumferentially about the exterior surface of said container body. The mounting projection is adapted to be pressed into contact with a portion of the inner surface of said peripheral wall of said container closure, and the container body further comprises a ridge located below said mounting projection on said container body. The ridge comprises means for engaging a lower edge of said peripheral wall of said container closure when said container closure is positioned on said container body. The container body further comprises a space located between first and second ends of said ridge and above a ridge receiveing portion. An area of the top panel of said container closure which is located above said space is adapted to be pushed downwardly, and two portions of the lower edge of the peripheral wall are engaged with opposite first and second ends of said ridge. The first and second ridge ends comprise fulcrums for pivoting said container closure about said container body. A part of the peripheral wall located between the two spaced apart lower edge portions is located above said space and is adapted to be moved downwardly along an angle or incline into said space when said top panel area is depressed. The container closure peripheral wall comprises a second area located oppositely from said space which is adapted to move upwardly along an angle from said container body and to therefore become disengaged from said container body when an opposite area of the top panel is depressed.

The container closure can comprise a thin metal plate, and the peripheral wall of said container closure has a curled portion which is curled outwardly.

The space is partially defined by the first and second ends of the ridge and is further defined by a receiving ridge portion which comprises means for receiving the part of the peripheral wall of said container closure which is moved downwardly at an angle when the top panel area is depressed. The container body mounting projection extends about the entire circumference of said container body in a substantially horizontal fashion.

First and second ridge ends are connected to the ridge receiving area. An annular projection is located about the interior surface of said peripheral wall of said container closure, said container closure peripheral wall annular projection comprising means for engaging said mounting projection of said container body when said closure is positioned on said body.

The ridge is attached to the periphery of said container body along a substantially horizontal line, and the container body further comprises an ear located below the space and projecting generally transversely outwardly from the container body.

In another aspect of the present invention, a container closure is adapted to be positioned over the open end of a substantially tubular container body. The closure comprises a substantially circular top panel, and a substantially tubular peripheral wall is connected to and extends downwardly from the periphery of the substantially circular top panel. The wall has a lower edge which is substantially curled, and the closure includes an inwardly directed substantially annular mounting bead portion located along an interior surface of said peripheral wall. The bead portion is adapted to engage a corresponding bead on a container body when the closure is mounted on the body.

An upwardly extending projection is formed as a substantially annular bead which extends upwardly from a main portion of the top panel.

The present invention is provided for in another aspect by a substantially tubular container having a closed lower end, a generally vertical barrel or wall portion extending upwardly from said lower end and being connected to said lower end, and a substantially open upper end. The container further comprises a generally annular mounting projection extending outwardly about an exterior surface of said barrel adjacent to said open end of said container, said container further comprising a ridge extending about said periphery of said barrel, said ridge being located between said mounting projection and said closed end of said container, wherein said ridge comprises opposed first and second ends located at substantially the same axial position along said container, said ridge extending about more than 180° of said barrel, said first and second ends extending into a receiving area connected to said first and second ends. An outwardly extending ear projects generally transversely from said receiving area. A container cover receiving space is thereby defined by the substantially saucer-shaped area between said first and second ends, said receiving area and said ear.

In accordance with another aspect of the present invention, a combined container body and closure is adapted to selectively seal an open end of said container body. The container body and closure combination comprise a substantially tubular container having an exterior barrel or wall surface, a first closed end at the bottom of the barrel, and a second, open end adjacent an upper portion of said barrel, said container body further comprising a ridge along an exterior surface thereof, said ridge having a main portion extending over a portion of said barrel at a predetermined axial position along said barrel and a receiving portion spaced downwardly from said main ridge portion between said main ridge portion and said closed end of said barrel. The combination also includes a closure adapted to sealingly engage the open end of the container when said closure is positioned over said open end. The closure comprises a top panel with a predetermined periphery and a peripheral wall extending downwardly from said periphery, said peripheral wall having a lower edge which is adapted to engage an upper edge of the main portion of said ridge when said closure is mounted on said container body.

The container and closure combination further comprises a space between said ridge receiving area and a portion of said lower edge of the peripheral wall when the closure is positioned on the container body.

The top panel of the closure comprises a substantially annular mounting projection extending inwardly, and an upper wall portion of said container barrel comprises a substantially annular mounting projection about the periphery of the barrel. An interior portion of the peripheral wall of said container closure comprises a generally inwardly directed, substantially annular projection, said two annular projections being adapted to abut each other and seal said closure to said container body when said closure is mounted over said open end of said container body.

The peripheral wall of the container closure comprises a lower edge which is curled upwardly, said curled lower edge comprising means for minimizing injury to users of said container body and said container closure who open and close said container. A space is provided between a portion of the lower edge of the peripheral wall of said closure and said ridge receiving portion when said closure is attached to said body; and an ear extends outwardly from said ridge receiving area.

In another aspect, the present invention provides for a method of opening a container which comprises a container body and a container closure. The container body has a first closed end, a second open end, a generally tubular barrel connecting said open and closed ends, and a generally peripheral ridge extending about said barrel at a predetermined axial position along said barrel, said closure having a generally circular top panel with a predetermined periphery and a peripheral wall extending downwardly from said periphery of said top panel. The container body has an outwardly extending, generally annular, peripheral mounting projection; and said peripheral wall of said closure comprises a generally inwardly directed annular mounting projection. The mounting projections are adapted to abut each other when said closure is positioned in sealing engagement on said container. The closure further comprises a lower edge located at the bottom of said peripheral wall, said lower edge being adapted to abut a main portion of said ridge when said closure is mounted on said container, said ridge including a receiving portion spaced downwardly from said main portion of said ridge, wherein said space is defined between said receiving portion of said ridge and a portion of the lower edge of said peripheral wall of said closure. The method of opening comprises depressing a portion of said top panel located above said space downwardly between first and second ends of said main ridge portion to force a first portion of said peripheral wall of said closure into said space, using the first and second ridge ends as fulcrums.

Further, the method comprises moving a second portion of the peripheral wall of said container closure which is positioned oppositely from said space upwardly to disengage said mounting projection of said peripheral wall of said closure from said mounting projection on said container body; and pulling said first portion of said peripheral wall further upwardly from said open end of said container body.

In another aspect, the present invention provides a method of closing a container comprising a container body and a container closure in which the container body has a first closed end, a second open end, a generally upstanding tubular wall or barrel connecting the ends, and a generally peripheral ridge extending about said barrel at a predetermined axial position along said barrel. The closure has a generally circular top panel with a predetermined periphery and a peripheral wall portion extending downwardly from said periphery of said top panel, said container body having an outwardly extending, generally annular, peripheral mounting projection and said peripheral wall of said closure comprising a generally inwardly directed annular mounting projection, said mounting projections adapted to abut each other when said closure is positioned in sealing engagement on said container, said closure further comprising a lower edge located at the bottom of said peripheral wall, said lower edge being adapted to abut a main portion of said ridge when said closure is mounted on said container. The ridge comprises a receiving portion spaced downwardly from said main portion of said ridge, wherein a space is defined between said receiving portion of said ridge and a portion of the lower edge of said peripheral wall of said closure. The method of closing comprises mounting the peripheral wall of said container closure about the outer surface of an upper portion of said barrel, over said open end, forcing said lower edge of said peripheral wall of said cover into engagement with said main ridge portion on said container body, and pressing said mounting projection on said cover into engagement with the mounting projection of the container body over the entire periphery of said container.

BRIEF DESCRIPTION OF THE DRAWINGS

The above and other objects, features and advantages of the present invention will be more fully described hereinafter with respect to the detailed drawings which accompany the specification, in which like reference numerals represent like parts throughout the specification, and wherein:

FIG. 5 is a front plan view of the container and closure of FIG. 4A.

DETAILED DESCRIPTION OF THE DRAWINGS

Figure 1:
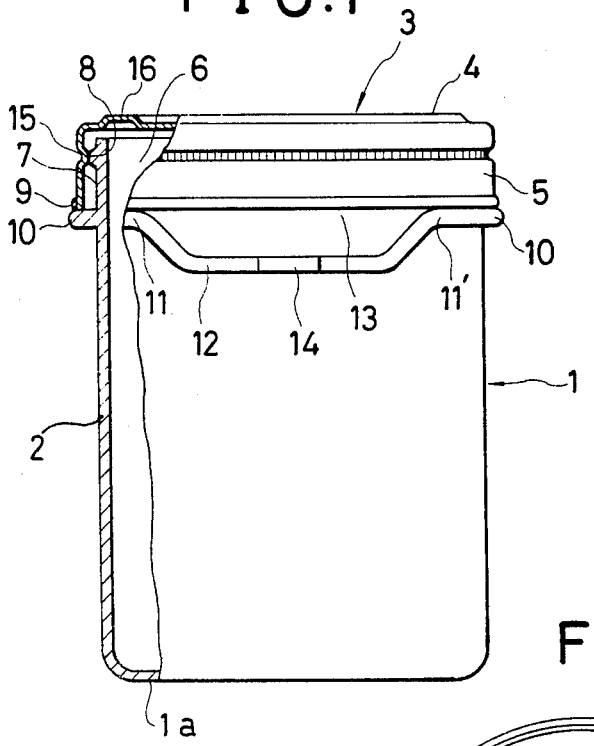
FIG. 1 is a partial sectional view of one embodiment of a container and a closure formed in accordance with the present invention.
Figure 2:
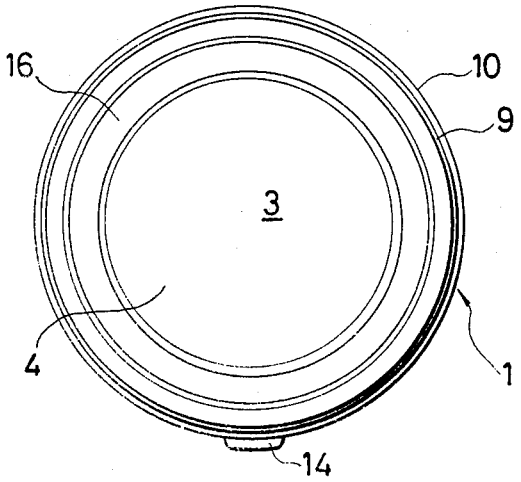
FIG. 2 is a top plan view of the container and closure of FIG. 1.
Figure 3:
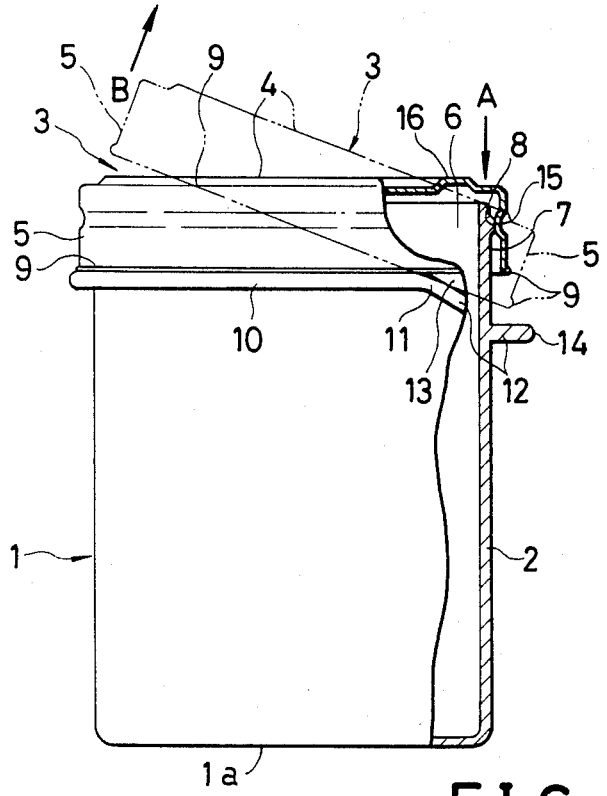
FIG. 3 is a partial sectional side view of the container of FIGS. 1 and 2 illustrating both the open (in dashed lines) and closed (in solid lines) positions of a container closure with respect to the container body on which it is mounted.

Referring more specifically to the drawings, FIGS. 1–3 illustrate an example which is representative of the present invention. Container body 1 comprises a tubular body having a closed lower end 1*a*, a substantially barrel-type main body portion 2, and a container closure 3 formed from a metallic thin plate material. The container closure comprises a top panel 4 and a downwardly extending peripheral wall 5 which extends downwardly from the entire circumferential edge of top panel 4 and which is provided at its lower end or edge 9 with a curled portion to minimize injuries to users of the closure. An inner surface of peripheral wall 5 of container closure 3 is mounted in a substantially air-tight fashion over an outer surface of upper peripheral wall 7, which in turn surrounds the upper opening 6 of barrel-shaped body portion 2 of main container body 1.

Further, in acco: dance with the present invention, at least one annular mounting projection 8, which is adapted to be pressed into contact or abutment with the inner surface of peripheral wall 5 of container closure 3, is provided along an exterior surface of peripheral wall 7, and is adapted to extend horizontally about the entire circumference of container body 1. This is best illustrated in FIG. 1, where projection or bead 8 is located adjacent an upper portion of body wall 2.

Further, ridge 10, which is adapted to be brought into engagement or abutment with the curled lower end edge 9 of peripheral wall 5 of container closure 3 when the closure is positioned on the body, is located along the outer surface of peripheral wall 7 and extends horizontally and circumferentially about container body 1 and below mounting projection portion 8.

A receiving area 12 is provided along an upper portion of the barrel 2 below a space 13 formed between first and second opposed ends 11, 11' of ridge 10. Both ends ofe receiving portion 12 are connected to respective opposite ridge ends 11 and 11' so that space 13 will be formed between the two ends of ridge 10 and above the receiving portion 12 which is connected to the ends of the ridge. The receiving portion 12 is spaced axially downwardly from the main portion of ridge 10.

Space 13 is provided so that when a portion of the top panel 4 of container closure 3 which is located above space 13 is pushed downwardly, part of lower end edge 9 of peripheral wall portion 5 which is located above space 13 will be permitted to move downwardly at an angle or incline into the space. During such movement, portions of lower end edge 9 will engage opposed ends 11 and 11' of ridge 10, and the ridge ends will function as fulcrums for further pivoting motion of the cover closure 3.

As illustrated in FIGS. 1 and 3, an ear 14 is provided along receiving portion 12 and beneath space 13 so as to indicate the position or location of the space, and an annular projection 15 is provided along the inner surface of peripheral wall 5 of container closure 3 so as to engage mounting projection portion 8 of container body 1 when the closure is mounted on the body. An upwardly extending bead 16 is provided along top panel 4 of closure 3, and is best illustrated in FIG. 3.

The closing operation of the container and its associated closure are hereinafter detailed. If the inner surface of peripheral wall 5 of container closure 3 is mounted on the outer surface of peripheral wall 7 which surrounds opening 6 of container body 1, lower end edge 9 of peripheral wall 5 will be brought into engagement with the main portion of outwardly extending ridge 10 on peripheral wall 7 of container body 1. Further, mounting projection 8 is provided as an annular portion along an exterior portion of peripheral wall 7 of container body 1 and is pressed into contact over its entire circumference with the inner surface of bead 15 on peripheral wall 5 of container closure 3 so that the container closure will be mounted in a substantially air-tight fashion to container body 1 in order to easily and reliably obtain a sealed container.

Opening of the apparatus is also described in detail hereinafter. Because of the existence of space 13 between opposite ends 11 and 11' of ridge 10, when the portion of top panel 4 of container closure 3 which is located above space 13 is pushed downwardly in the direction of arrow A (see FIG. 3), the opposite ends 11 and 11' of ridge 10 are forced to serve as fulcrums for pivotal opening movement of the closure; simultaneously, as illustrated by the dotted lines, the portions of lower edge 9 of peripheral wall 5 located above space 13 and between the fulcrums are permitted to move downwardly along an angle or incline until these portions of lower edge 9 are brought into abutment with receiving portion 12, which is located below space 13 of ridge 10. At the same time, the region of peripheral wall 5 of container closure 3 which is located on the opposite side of the container from space 13 is caused to move upwardly in the direction of arrow B, and thus becomes disengaged from mounting projection portion 8 of peripheral wall 7 of container body 1. Thereafter, the opposite, i.e., angled, side region of peripheral wall 5 can be pulled by the fingers of a user so that container closure 3 can be easily removed from container body 1 in order to use the container in its open fashion.

Figure 4:
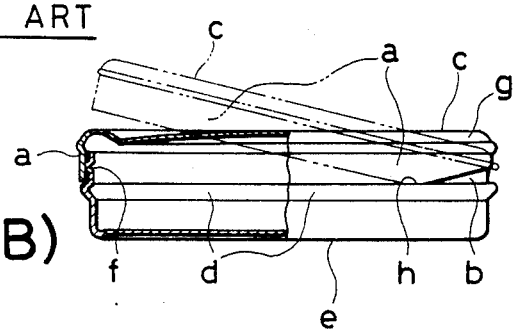
FIG. 4 (A) PRIOR ART
FIG. 4A is a partial sectional side view of a container closure mounted on a container body in a conventional fashion.
Figure 4B:
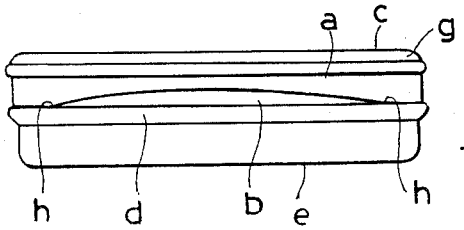

Because peripheral wall 5 of container closure 3 is not provided with a cut-out opening portion as in the conventional container closure illustrated in FIGS. 4A and 4B, radial widening of peripheral wall portion 5 of container closure 3 will not occur, as happens in the prior art, even when top panel portion 4 of the closure is pushed downwardly, regardless of the size of the outer diameter of the container. Thus, because no cut-out portion is provided, even when the container has a relatively large diameter, the areas of peripheral wall 5 of closure 3 which are in abutment with opposite ends 11 and 11' of ridge 10 serve as fulcrums during opening of the closure and are not widened radially. Accordingly, the lower edge of the closure will not become separated from ridge 10 during opening, and opening will occur in a simple and reliable fashion. Only after the pivotal opening of the container will the closure be removed from the container body.

Further, because lower end edge 9 of peripheral wall portion 5 of container closure 3 includes a curled portion, it serves to prevent the fingers of a user from becoming injured by contact with what would otherwise be a blunt lower edge 9 during opening and closing of the container; this provides the container and closure with an increased safety factor.

Additionally, because container body 1 has a receiving portion 12, when top panel 4 of container closure 3 is pushed downwardly with a relatively strong force during opening, even if the downward motion of lower end edge 9 of peripheral wall 5 of container closure 3 is performed in a single stroke, lower end edge 9 will be brought into abutment with receiving portion 12 to prevent container closure 3 from slipping downwardly from the container body.

Thus, in accordance with the present invention, a space is provided between opposite ends of the ridge along the peripheral wall of the container body so that when a portion of the lower end edge of the peripheral wall of the container closure which is located above the space is pushed downwardly, this portion of the peripheral wall of the container closure will be moved at an angle downwardly into the space; in conjunction with such motion, a region of the peripheral wall of the container closure which is located on the side of the closure opposite from the space will be moved upwardly to disengage the container closure from the container body, thus effecting easy opening of the container closure.

Further, the peripheral wall of the container closure is not provided with a cut-out opening as in conventional container closures, so that when the top panel of the container closure is pushed downwardly, no radial widening of the peripheral wall portion will occur, and opening of the container closure can be performed reliably and safely. Such operation can occur without fear of injuring the fingers of a user on the lower end edge of the container closure, and a sealed container results which is safer and easier to open than are conventional containers for users who are opening and closing the container repeatedly.

Modifications of the above embodiments can easily be adapted to the present invention without altering or affecting the scope thereof, and such modifications are believed to be within the scope of the present invention for those of ordinary skill in the art.

What is claimed is:

1. A selectively sealable container comprising a container body and a container closure, said container closure having a top panel and a depending peripheral wall extending downwardly from the periphery of said top panel, said container closure being adapted to be mounted in a substantially air-tight fashion over an exterior surface of said container body, said container body further comprising at least one open end, said container body having a mounting projection located circumferentially about the exterior surface of said container body, said mounting projection being adapted to be pressed into contact with a portion of the inner surface of said peripheral wall of said container closure, said container body further comprising a ridge located below said mounting projection on said container body, said ridge comprising means for engaging at least a portion of the lower edge of said peripheral wall of said container closure when said container closure is positioned on said container body, said container body further comprising a space located between first and second ends of said ridge, wherein said container closure further comprises an annular projection located about the interior surface of said peripheral wall of said container closure, said container closure peripheral wall annular projection comprising means for engaging said mounting projection of said container body when said closure is positioned on said body, wherein an area of said top panel of said container closure located above said space is adapted to be pushed downwardly, and wherein two spaced apart portions of said lower edge of said peripheral wall on said container closure are in engagement with said first and second ends of said ridge on said container body, said first and second ridge ends comprising fulcrums for pivoting said container closure about said container body, wherein a part of said peripheral wall located between said two spaced apart edge portions is located above said space and is adapted to be moved downwardly along an angle into said space when said top panel area is depressed, said container closure peripheral wall further comprising a second area located oppositely from said space, said second area being adapted to move upwardly along an angle from said container body and to thereby become disengaged from said container body, said container body further comprising an ear located below said space and defining a bottom portion of said space, said ear projecting generally transversely outwardly from said container body and extending away from said container by a distance greater than the distance that said ridge extends away from said container body.

2. A sealed container in accordance with claim 1 wherein said container closure comprises a thin metal plate.

3. A sealed container in accordance with claim 2 wherein said lower edge of said peripheral wall of said container closure has a curled portion which is curled outwardly.

4. A sealed container in accordance with claim 1 wherein said space which is located between said first and second ends of said ridge further comprises a receiving ridge portion which comprises means for receiving said part of said peripheral wall of said container closure which moves downwardly along an angle when said top panel area is depressed, said ear being located adjacent to said receiving ridge portion and extending outwardly from said receiving ridge portion away from said container body.

5. A sealed container in accordance with claim 4 wherein said first and second ridge ends are connected to said receiving area.

6. A sealed container in accordance with claim 1 wherein said container body mounting projection extends about the entire periphery of said container body in a substantially horizontal fashion.

7. A sealed container in accordance with claim 1 wherein at least a portion of said ridge is attached to the periphery of said container body along a substantially horizontal line.

8. A sealed container formed in accordance with claim 1 wherein said ear comprises means for indicating the location of said space, said ear further comprising a catch for the finger of a user when said closure member is pushed downwardly into said space.

9. A container in accordance with claim 1 wherein said ridge and said lower edge of said peripheral wall are in continuous engagement about the periphery of said container, except along the peripheral portion of said container where said space is located.

10. A substantially tubular container having a closed lower end, a generally vertical barrel or wall portion extending upwardly from said lower end and being connected to said lower end, and a substantially open upper end, said container further comprising a generally annular mounting projection extending outwardly about an exterior surface of said barrel adjacent to said open end of said container, said container further comprising a ridge extending about said periphery of said barrel, said ridge being located between said mounting projection and said closed end of said container, wherein said ridge comprises opposed first and second ends located at substantially the same axial position along said container, said ridge having a main portion extending around more than 180° of said barrel between said first and second ends, said first and second ends extending into a receiving area connected to said first and second ends, and an outwardly extending ear projecting generally transversely from said receiving area, said ear extending away from said wall portion of said container by a distance which is greater than the distance from which said ridge extends away from said container, said ear thereby comprising means for indicating where a container cover receiving space is located when a container cover is positioned thereon, wherein said container cover receiving space is defined by the substantially frustoconical area between said first and second ends, said receiving area and said ear.

11. A container body and a container closure which is adapted to selectively seal an open end of said container, said container body and closure comprising:

(a) a substantially tubular container including a barrel or wall body portion, a first closed end at the bottom of said barrel, and a second, open end adjacent an upper portion of said barrel, said container body further comprising a ridge along an exterior surface thereof, said ridge having a main portion extending over a portion of said barrel at a predetermined axial position along said barrel and a receiving portion spaced downwardly from said main portion and located between said main ridge portion and said closed end of said barrel, wherein an upper wall portion of said container barrel comprises a substantially annular mounting projection located about the periphery of said barrel; and (b) a closure adapted to sealingly engage the open end of said container body when said closure is positioned over said open end, said closure comprising a top panel with a predetermined periphery and a peripheral wall extending downwardly from said periphery, said peripheral wall having a lower edge which is adapted to engage an upper edge of the main portion of said ridge when said closure is mounted on said container body, said container closure having an interior peripheral wall portion which comprises a generally inwardly directed, substantially annular projection, said annular projection of said container closure and said annular projection of said container barrel being adapted to abut each other in substantially linear contact in order to disengageably seal said closure to said container body when said closure is mounted over said open end of container body, said body and closure further comprising a space located between a portion of the lower edge of said peripheral wall of said closure and said ridge receiving portion of said container body when said closure is attached to said body, wherein said container body further comprises an ear extending outwardly from said ridge receiving portion and being substantially integrally attached thereto, said ear projecting outwardly from said container barrel by a distance which is greater than the distance that said ridge extends outwardly from said container barrel, said ear thereby comprising means for indicating the location of said space and comprising means for catching the finger of a user when said closure member is pushed downwardly to open said container.

12. A container in accordance with claim 11 wherein said ridge and said lower edge of said peripheral wall are in continuous engagement about the periphery of said container, except along a peripheral portion of said container where said space is located.

13. A container body and closure combination in accordance with claim 11 wherein said top panel of said closure comprises a substantially annular projection extending upwardly from a main portion of said top panel.

14. A container body and container closure combination in accordance with claim 11 wherein said peripheral wall of said container closure comprises a lower edge which is curled upwardly, said curled lower edge comprising means for minimizing injury to users of said container body and said container closure who open and close said container.

* * * * *

UNITED STATES PATENT AND TRADEMARK OFFICE

CERTIFICATE OF CORRECTION

PATENT NO. : 4,723,676

DATED : February 9, 1988

INVENTOR(S) : N. KOBAYASHI et al.

It is certified that error appears in the above-identified patent and that said Letters Patent is hereby corrected as shown below:

At column 3, line 1, insert ---is--- after "which".

At column 3, line 52, change "receiveing" to ---receiving---.

At column 7, line 42, change "ofe" to ---of---.

Signed and Sealed this

Twenty-seventh Day of September, 1988

*Attest:*

DONALD J. QUIGG

*Attesting Officer*

*Commissioner of Patents and Trademarks*